US005897099A

United States Patent [19]

Fujimoto et al.

[11] Patent Number: 5,897,099

[45] Date of Patent: Apr. 27, 1999

[54] EXPANSION VALVE AND REFRIGERATING SYSTEM

[75] Inventors: Mitsuya Fujimoto; Kazuhiko Watanabe, both of Tokyo, Japan

[73] Assignee: Fujikoki Corporation, Tokyo, Japan

[21] Appl. No.: 08/651,536

[22] Filed: May 22, 1996

[30] Foreign Application Priority Data

Nov. 22, 1995 [JP] Japan ..... 7-304327

[51] Int. Cl.[6] ..... F16K 31/00

[52] U.S. Cl. ..... 251/360; 251/359

[58] Field of Search ..... 251/360, 359

[56] References Cited

U.S. PATENT DOCUMENTS

| | | | |
|---|---|---|---|
| 1,512,243 | 10/1924 | Shrode . | |
| 1,987,948 | 1/1935 | Smith . | |
| 2,306,768 | 12/1942 | Wile . | |
| 2,598,187 | 5/1952 | Meyer | 251/360 |
| 2,631,612 | 3/1953 | Buescher | 251/360 |
| 4,542,879 | 9/1985 | Stein | 251/360 |
| 4,815,698 | 3/1989 | Palmer . | |
| 4,834,337 | 5/1989 | Chorkey et al. | 251/360 |

FOREIGN PATENT DOCUMENTS

| | | | |
|---|---|---|---|
| 831073 | 12/1937 | France . | |
| 1050101 | 2/1952 | France . | |
| 5-322381 | 12/1993 | Japan . | |
| 696 | of 1898 | United Kingdom | 251/360 |

*Primary Examiner*—A. Michael Chambers
*Attorney, Agent, or Firm*—Foley & Lardner

[57] ABSTRACT

An expansion valve comprises an orifice 30 formed in a valve body 10 and a valve member 9 fixed to a movable member 18. Movement of a diaphragm 4 is transmitted to an actuating rod 17 via a member 16, and the actuating rod 17 actuates the movable member 18 to control the opening rate of the path between the valve member 9 and the orifice 30. A seat nut member 100 affixed to the orifice 30 has a large-diameter hole 108 and a small-diameter hole 110 directly communicating with each other. Hot pressurized refrigerant introduced into the large-diameter hole 108 heats a seat portion at the exit of the large-diameter hole, and prevents moisture in the refrigerant from freezing there.

7 Claims, 6 Drawing Sheets

EXPANSION VALVE AND REFRIGERATING SYSTEM

BACKGROUND OF THE INVENTION

1. Field of the Invention

This invention relates to an expansion valve for use in an air conditioner of a car, refrigerating display case, or the like.

2. Description of the Prior Art

FIG. 5 shows a cooling cycle of an air conditioner. The cooling cycle 50 comprises a compressor 51 driven by a motor or its equivalent, a condenser 52 for cooling and condensing a gaseous refrigerant heated and pressurized by the compressor 51, a liquid tank 53 for separating the refrigerant condensed by the condenser 52 into vapor and liquid and for removing moisture and dust from the refrigerant, an expansion valve 54 for expanding the refrigerant from the liquid tank 53, and an evaporator 55 for heat exchange between air and the refrigerant to cool the air to be blown into the compartment, which all are connected by a pipe network.

A general aspect of a conventional expansion valve, 54, used in the refrigeration cycle is shown in the cross-sectional view of FIG. 6, and its valve chamber is shown in FIG. 7 in an enlarged scale.

In FIG. 6, the expansion valve comprises a valve portion A for decreasing the pressure of a highly pressurized liquid refrigerant, and a power element portion B for controlling the opening rate of the valve portion A.

The power element portion B includes a power element outer shell 3 comprising an upper cover portion 1 and a lower support portion 2 (diaphragm receiver), and a diaphragm 4 sandwiched and welded between outer circumferential edges of the upper cover portion 1 and the lower support portion 2. The diaphragm 4 divides an interior space in the power element outer shell 3 into upper and lower chambers, namely, a pressurizing chamber 5 and an equalizing chamber 6, and the pressurizing chamber 5 communicates with the interior of a heat-sensitive cylinder 8 through a conduit 7.

The heat-sensitive cylinder 8 is provided at an exit portion of an evaporator (not shown) to detect the temperature of the refrigerant near the exit of the evaporator and to convert the temperature into a pressure which is the pressure of the power element space (pressurizing chamber 5). The pressure, when increased, gives a force for pressing the diaphragm 4 downwardly and for moving the valve member 9 in its opening direction.

The valve portion A comprises a valve body 10 in form of an outer shell made of brass and having an inlet 11 for introducing pressurized refrigerant and an outlet 12 for delivering depressurized refrigerant. The valve body 10 defines a valve chamber 13, and an equalizing path 14 communicating the valve chamber 13 with the equalizing chamber 6.

The valve body 10 includes a hitching member 15 which is fixed to its lower threaded end by screw engagement. Assembled to and in the valve body 10 are a movement regulating member 16 which cooperates with the diaphragm 4 to regulate downward movements of the diaphragm 4; actuating rods 17 for transmitting the displacement of the diaphragm 4 to the lower mechanism (although only one actuating rod is illustrated, three rods are provided at predetermined intervals in the circumferential direction of a valve mover 18 to move vertically in three vertical holes formed in the valve body 10); a valve member 9 brought into contact with or away from a valve seat 19 (the drawing illustrates a needle valve supported on the valve mover 18); a biasing spring 20 which energizes the valve member 9 upwardly (toward the valve seat 19); and an adjusting member 21 for adjusting the biasing force of the spring 20.

The adjusting member 21 is a polygonal nut, e.g. a hexagonal nut, which is slidably received in the inner polygonal hole of the hitching member 15 and engages with an adjusting bolt 22 by screw engagement to move up and down in response to a rotation of the adjusting bolt 22. The adjusting bolt 22 has a polygonal lower end 22*a* to be rotated for adjustment, and rotatably received in the hitching member 15 through the seal of an O-ring 23 such that the lower end 22*a* projects downwardly from the lower end of the hitching member 15.

The hitching member 15 has a threaded open end with which a protective cap 25 having a seal packing 24 on its inner circumferential surface is removably attached such that an operator can rotate the adjusting bolt 22 by removing the protective cap 25.

FIG. 4 is a fragmentary view of an orifice portion shown in FIG. 7. The orifice, 150, formed in the valve body 10 has one end behaving as the valve seat 19. The valve body 9 moved to and away from the valve seat 19 provides a flow path 160.

In case of an expansion valve in which the orifice 150 has a small inner diameter D1 across the inner wall 152 and is relatively long and in which refrigerant flows in the direction shown by the arrow F, the refrigerant running through the orifice 150 suddenly expands in the flow path 160 between the orifice 150 and the valve body 9.

Eventually, the temperature of the refrigerant decreases, for example, from 40° C. higher than the room temperature within the orifice 150 to −20° C. after expansion.

In this process, moisture contained in the refrigerant is likely to cohere into water drops on surfaces of the valve member 9 and the valve seat 19 and often bars the flow path.

SUMMARY OF THE INVENTION

It is therefore an object of the invention to provide a novel expansion valve that overcomes the above-explained drawback.

According to the invention, there is provided an expansion valve in which an orifice has a valve seat portion which includes a large-diameter hole portion having a larger diameter than that of the orifice and a small-diameter hole portion having a smaller diameter than that of the large-diameter hole portion and continuous from one end of the large-diameter hole portion nearer to the outlet path.

In another aspect of the invention, there is provided an expansion valve in which the large-diameter hole portion and the small-diameter hole portion preferably comprise a seat nut member which defines a seat portion for contact with a valve member; a small-diameter hole portion continuous from the seat portion; and a large-diameter hole portion continuous from the small-diameter hole portion, and is brought into screw engagement with the orifice portion.

In the expansion valve having this configuration, since the large-diameter hole portion provides a large area for introducing hot pressurized refrigerant, cooling of the entire seat portion can be alleviated, and freezing of moisture onto surfaces surrounding the flow path can be prevented.

DESCRIPTION OF THE PREFERRED EMBODIMENTS

Explained below is an embodiment of the invention with reference to the drawings.

Figure 1:
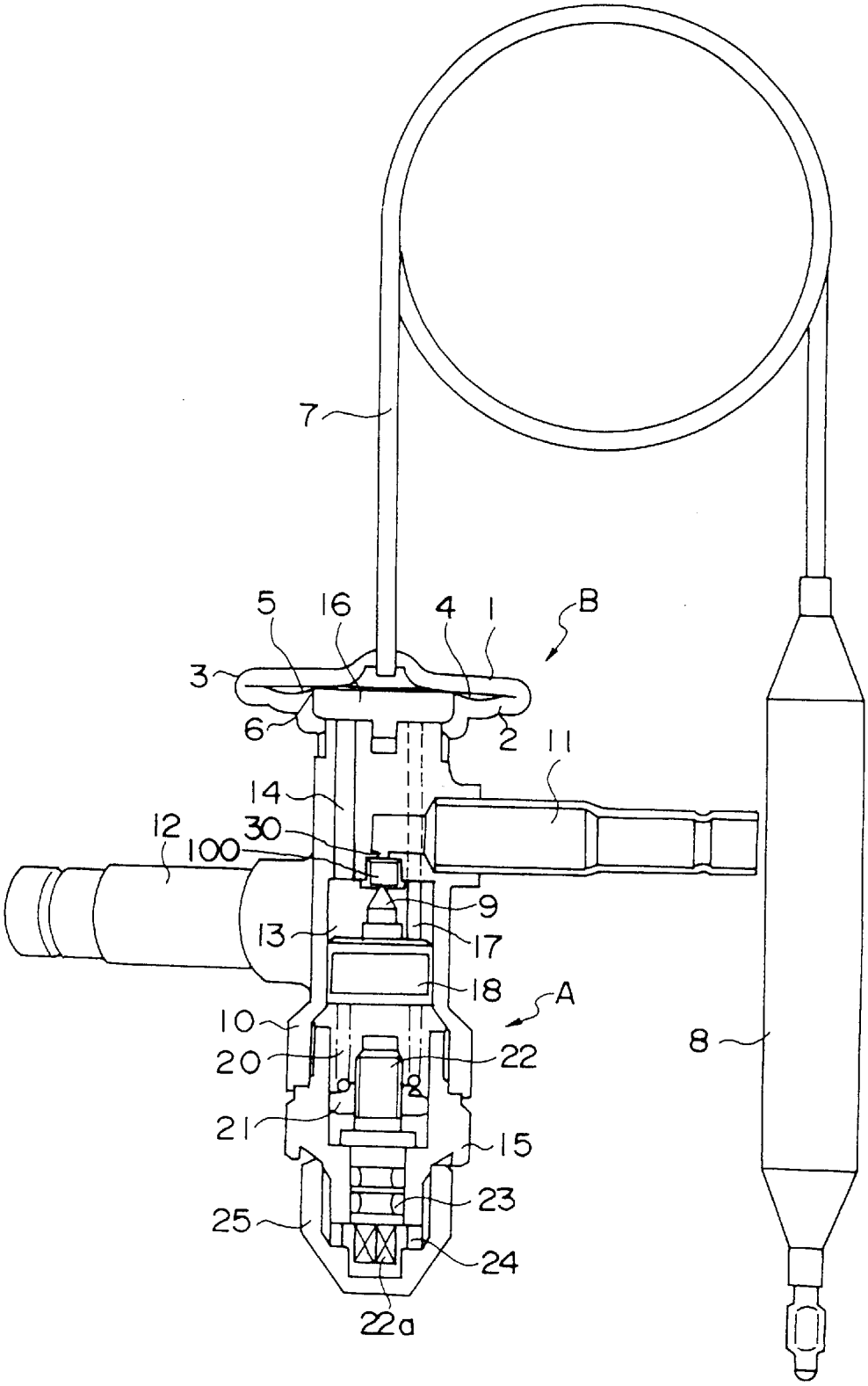
FIG. 1 is a longitudinal cross-sectional view of the entirety of an internally equalized expansion valve according to the invention.
Figure 6:
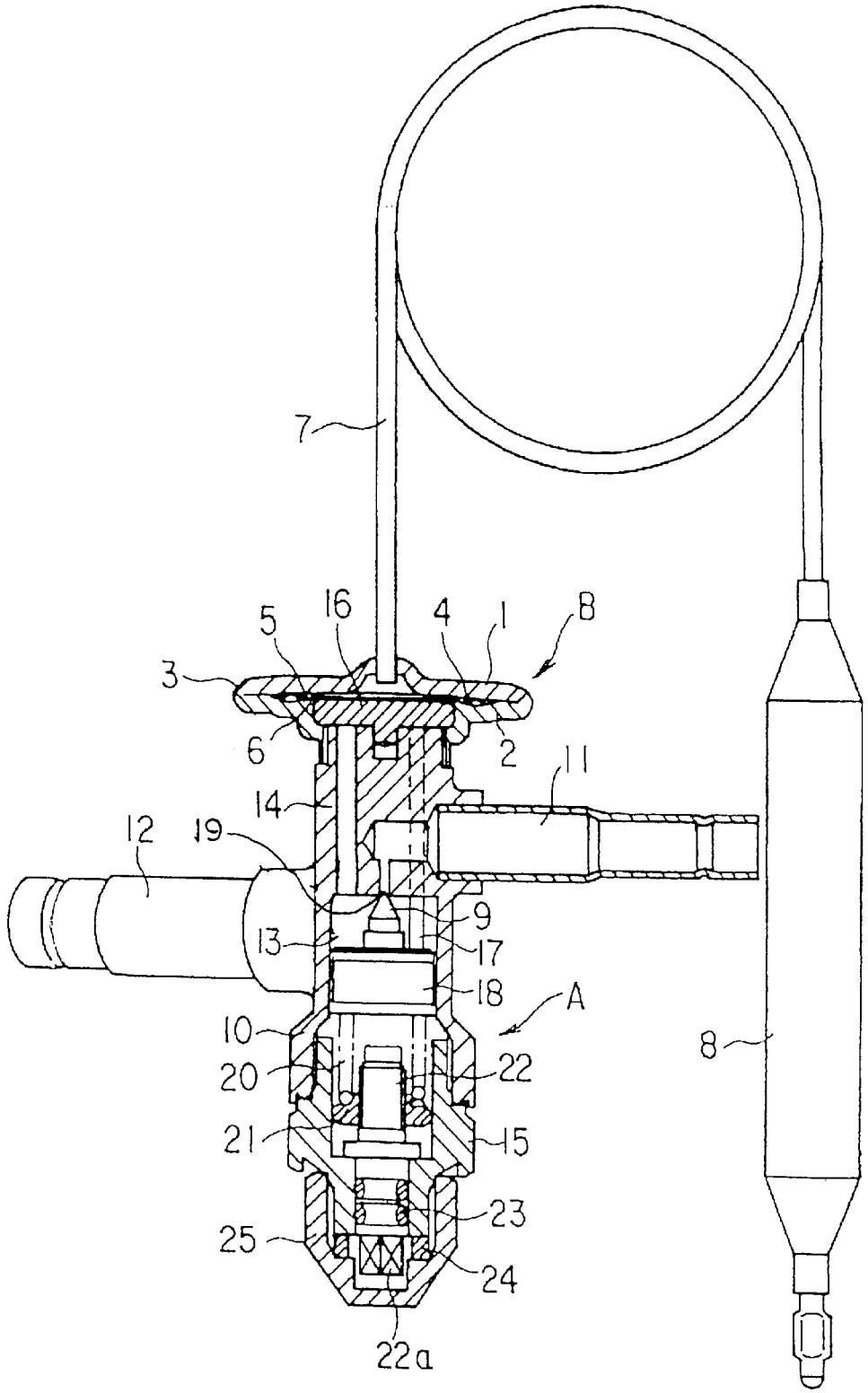
FIG. 6 is a longitudinal cross-sectional view of the entirety of a conventional expansion valve.
Figure 7:
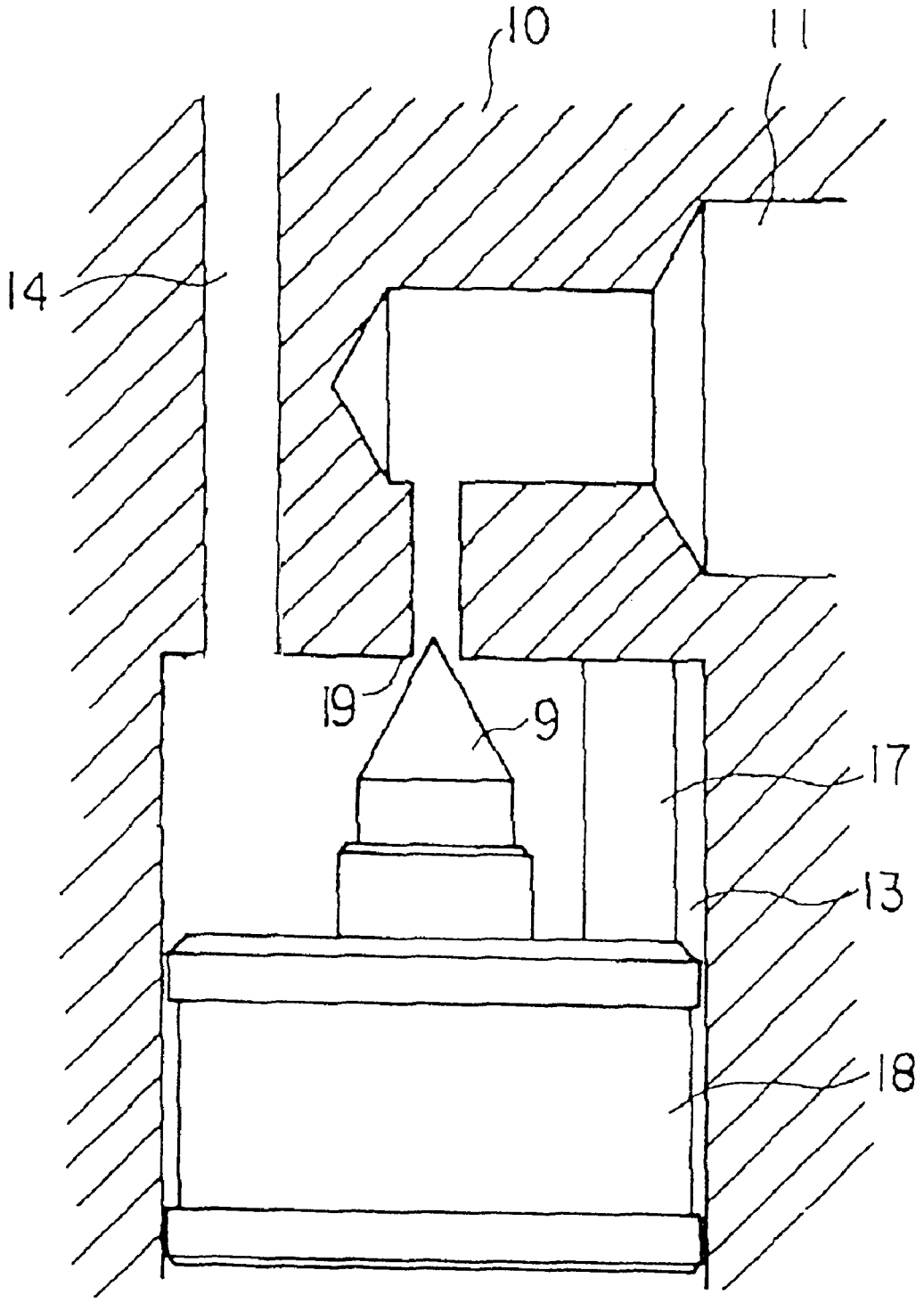
FIG. 7 is a fragmentary view of the conventional expansion valve shown in FIG. 6.

An expansion valve according to the invention is shown in FIG. 1 in which the general construction except for a valve seat portion is substantially the same as that of the expansion valve shown in FIG. 6, and the same or equivalent elements are labelled with reference numerals common to FIG. 6. The expansion valve comprises a valve portion A for decreasing the pressure of a highly pressurized liquid refrigerant, and a power element portion B for controlling the opening rate of the valve portion A.

The power element portion B includes a power element outer shell 3 comprising an upper cover portion 1 and a lower support portion 2 (diaphragm receiver), and a diaphragm 4 sandwiched and welded between outer circumferential edges of the upper cover portion 1 and the lower support portion 2. The diaphragm 4 divides an interior space in the power element outer shell 3 into upper and lower chambers, namely, a pressurizing chamber 5 and an equalizing chamber 6, and the pressurizing chamber 5 communicates with the interior of a heat-sensitive cylinder 8 through a conduit 7.

The heat-sensitive cylinder 8 is provided at an exit portion of an evaporator (not shown) to detect the temperature of the refrigerant near the exit of the evaporator and to convert the temperature into a pressure which is the pressure of the power element space (pressurizing chamber 5). The pressure, when increased, gives a force for pressing the diaphragm 4 downwardly and for moving the valve member 9 in its opening direction.

The valve portion A comprises a valve body 10 in form of an outer shell made of brass and having an inlet 11 for introducing pressurized refrigerant and an outlet 12 for delivering depressurized refrigerant. The valve body 10 defines an orifice 30 and a valve chamber 13 which communicates the inlet 11 with the outlet 12, and also defines an equalizing path 14 which communicates the equalizing chamber 6 with the valve chamber 13.

The valve body 10 includes a hitching member 15 which is fixed to its lower threaded end by screw engagement. Assembled to and in the valve body 10 are a movement regulating member 16 which cooperates with the diaphragm 4 to regulate downward movements of the diaphragm 4; actuating rods 17 for transmitting the displacement of the diaphragm 4 to the lower mechanism (although only one actuating rod is illustrated, three rods are provided at predetermined intervals in the circumferential direction of a valve mover 18 to move vertically in three vertical holes formed in the valve body 10); a valve member 9 brought into contact with or away from a valve seat formed at an end of the orifice 30 (the drawing shows a needle valve supported on the valve mover 18); a biasing spring 20 which energizes the valve member 9 upwardly (toward the valve seat portion); and an adjusting member 21 for adjusting the biasing force of the spring 20.

The adjusting member 21 is a polygonal nut, e.g. a hexagonal nut, which is slidably received in the inner polygonal hole of the hitching member 15 and engages with an adjusting bolt 22 by screw engagement to move up and down in response to a rotation of the adjusting bolt 22. The adjusting bolt 22 has a polygonal lower end 22*a* to be rotated for adjustment, and rotatably received in the hitching member 15 through the seal of an O-ring 23 such that the lower end 22*a* projects downwardly from the lower end of the hitching member 15.

The hitching member 15 has a threaded open end with which a protective cap 25 having a seal packing 24 on its inner circumferential surface is removably attached such that an operator can rotate the adjusting bolt 22 by removing the protective cap 25.

In the expansion valve configured as explained above, the present invention particularly uses a seat nut member 100 coupled with the orifice 30.

Figure 2:
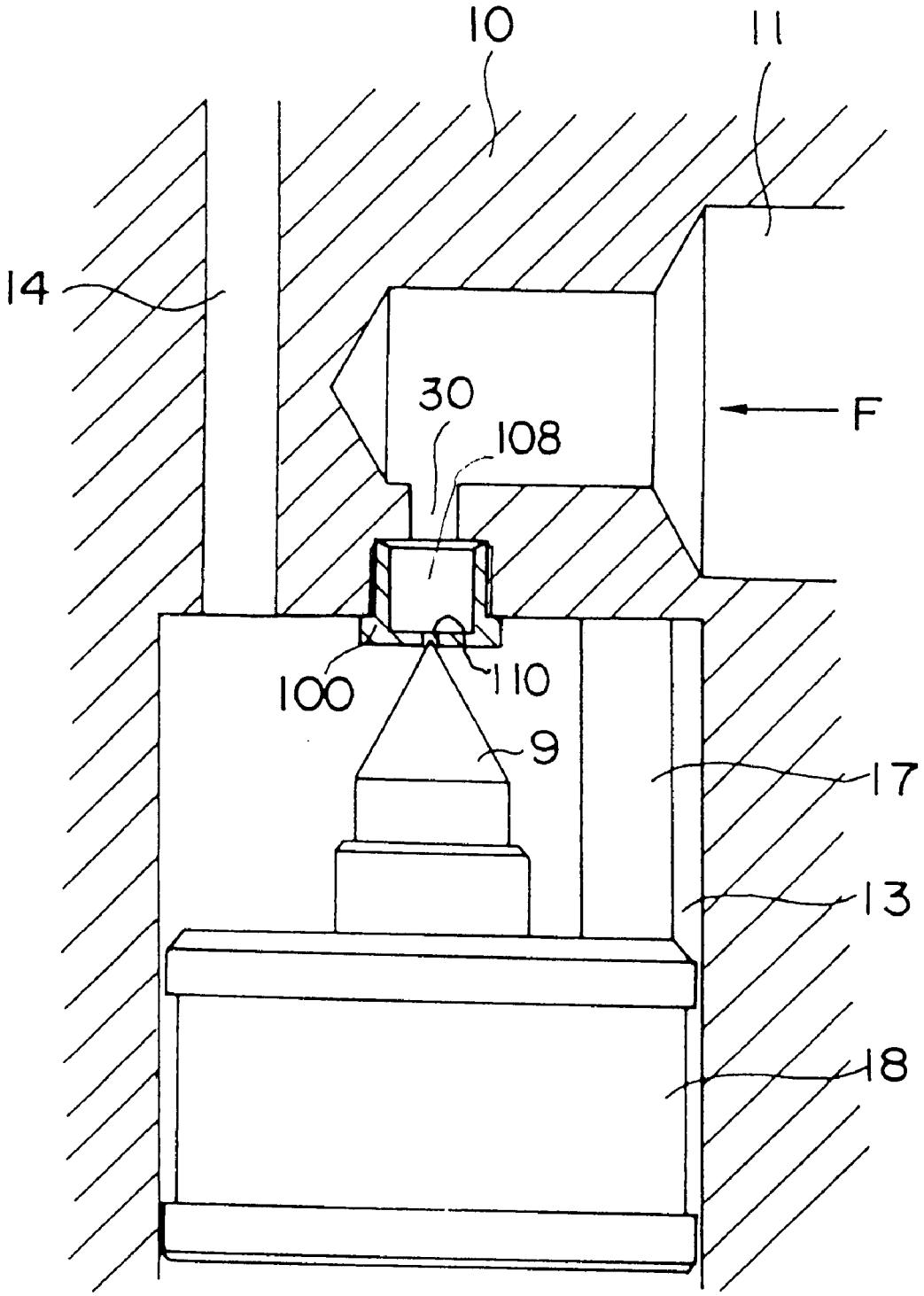
FIG. 2 is an enlarged, fragmentary, cross-sectional view of a portion where a seat nut member is attached.

FIG. 2 shows the seat nut member 100 secured in the orifice 30. The seat nut member 100 is made of a metallic material harder than the material of the valve body 10. More specifically, if the valve body 10 is made of brass, then the seat nut member 100 is made of stainless steel. The valve member 9 is also made of stainless steel. Although the expansion valve shown in FIG. 1 is of an internally equalized type, the invention can be applied to various types of expansion valves other than that of FIG. 1.

Figure 3:
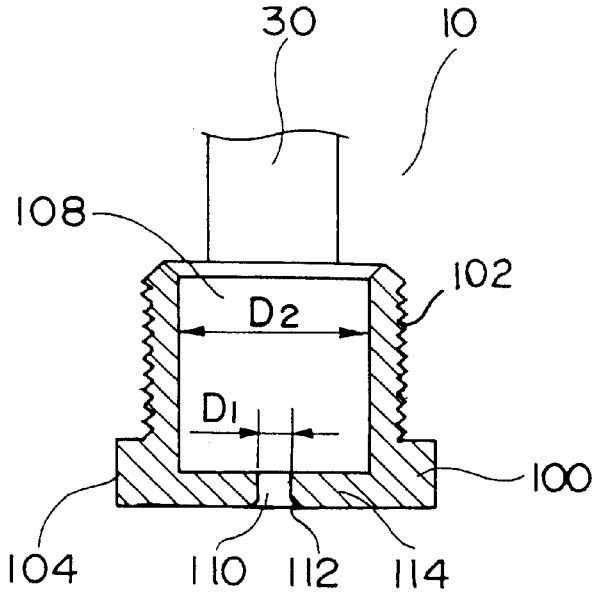
FIG. 3 is a cross-sectional view of the seat nut member.
Figure 4:
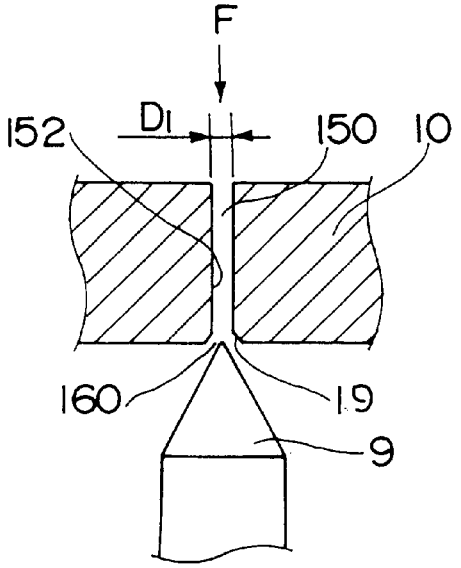
FIG. 4 is a fragmentary cross-sectional view of a conventional expansion valve.
Figure 5:
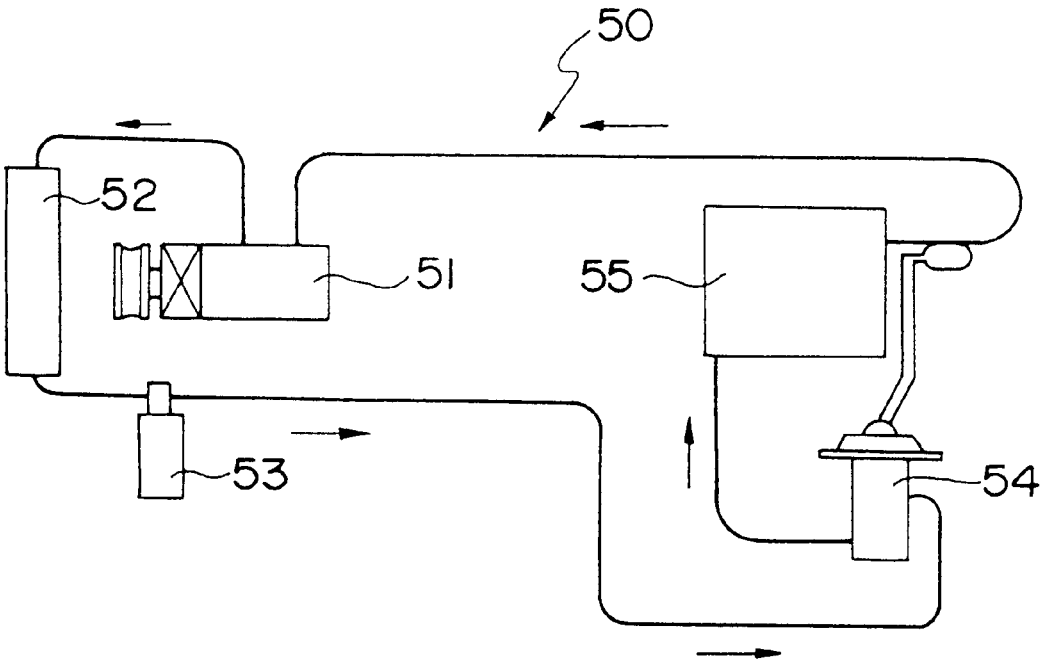
FIG. 5 is a diagram showing a refrigerating cycle.

FIG. 3 shows a cross-section of the seat nut member 100 in greater detail.

The seat nut member 100 has a threaded outer circumferential surface 102 for screw engagement with a threaded end of the orifice 30 of the valve body 10. To afford a hold by a wrench or a like other tool for fixing the seat nut member 100 to the orifice 30, the seat nut member 100 has a hexagonal flange portion 104 at one end.

The seat nut member 100 defines a large-diameter hole portion 108 whose inner diameter is D2. A bottom wall 114 of the seat nut member 100 nearer to the valve member 9, which constitutes the bottom of the large-diameter hole portion 108, has a small-diameter hole portion 110 whose diameter is D1. The thickness of the bottom wall 114, i.e. the length of the small-diameter hole portion 110, is smaller than the thickness of the hexagonal flange portion 104 formed on the outer circumferential surface.

One end of the small-diameter hole portion 110 nearer to the valve member 9 forms a seat portion 112.

When pressurized refrigerant is introduced into the large-diameter hole portion 108 of the seat nut member 100, the interior of the large-diameter hole portion 108 is a high-temperature region. The temperature of the refrigerant in the large-diameter hole portion 108 is as high as 40° C., for example, and heats the inner surface of the small-diameter hole portion 110, the seat portion 112, etc.

Therefore, even if moisture in the refrigerant freezes when the refrigerant expands and cools down after passing through the flow path between the seat portion 112 and the valve member 9, the frost does not cohere to the seat portion 112 and others which are heated by the hot refrigerant, and does not clog the flow path.

The diameter D1 of the small-diameter hole portion 110 in the seat nut member 100 shown in FIG. 3 may be the same as the diameter of the orifice 30.

Although the seat portion 112 of the seat nut member 100 shown in FIG. 3 is tapered, it may be modified to form a non-beveled edge.

As described above, in the expansion valve according to the invention using the valve body having the inlet path for pressurized refrigerant, the outlet path for depressurized refrigerant and the orifice communicating with the inlet path with the outlet path, in combination with the valve member disposed downstream the orifice, the seat portion for contact with the valve member is proximate to the high-temperature region and heated. Therefore, it is prevented that moisture in refrigerant freezes onto elements surrounding the flow path when the refrigerant flows therethrough to the outlet path while expanding the volume and reducing the pressure.

What is claimed is:

1. An expansion valve orifice for connecting an inlet path to an outlet path of an expansion valve, the orifice comprising:

an upstream end nearer to the inlet path;

a downstream end nearer to the outlet path;

a valve seat portion at said downstream end;

a large-diameter portion interposed between said inlet path and said valve seat portion, said large-diameter portion having a larger diameter than said upstream end; and a small-diameter portion for connecting said valve seat portion and said large-diameter portion, said small-diameter portion having a smaller diameter than said upstream end.

2. An expansion valve including a valve body in combination with a valve member, the valve body defining an inlet path for pressurized refrigerant, an outlet path for depressurized refrigerant, and an orifice communicating the inlet path with the outlet path, the valve member being disposed adjacent to a downstream end of the orifice nearer to the outlet path to open or close the downstream end of the orifice, the expansion valve comprising:

a valve seat portion being located at the downstream end of the orifice for contacting the valve member;

a large-diameter hole being interposed between the inlet path and said valve seat portion, said large-diameter hole having a larger diameter than that of an upstream end of the orifice nearer to the inlet path; and a small-diameter hole connecting said valve seat portion and said large-diameter hole, said small-diameter hole having a smaller diameter than that of said large-diameter hole.

3. The expansion valve according to claim 2, wherein said small-diameter hole diameter is smaller than that of the upstream end of the orifice nearer to the inlet path.

4. An expansion valve including a valve body in combination with a valve member, the valve body defining an inlet path for pressurized refrigerant, an outlet path for depressurized refrigerant, and an orifice communicating the inlet path with the outlet path, the valve member being disposed adjacent to a downstream end of the orifice nearer to the outlet path to open or close the downstream end of the orifice, the expansion valve comprising:

a seat nut member being fixed in the orifice, said seat nut member having a seat portion for contacting the valve member and a small-diameter hole connecting said seat portion with a large-diameter hole, said large diameter-hole being interposed between said small-diameter hole and the inlet path, said large-diameter hole having a larger diameter than an upstream end of the orifice nearer to the inlet path.

5. The expansion valve according to claim 4, wherein said seat nut member has a grip portion which provides a hexagonal outer circumferential surface to be gripped by a wrench.

6. The expansion valve according to claim 5, wherein said seat portion has a thickness smaller than the thickness of said grip portion.

7. The expansion valve according to claim 4, wherein said seat nut member is made of a stainless material.

* * * * *